US005429518A

United States Patent [19]

Chen

[11] Patent Number: 5,429,518

[45] Date of Patent: Jul. 4, 1995

[54] SOCKET TERMINAL

[76] Inventor: Ken C. Chen, 2nd Fl., No. 13, Lane 125, Fu Ying Rd., Hsin Chuang City, Taipei Hsien, Taiwan

[21] Appl. No.: 206,736

[22] Filed: Mar. 7, 1994

[51] Int. Cl.[6] ..... H01R 29/00

[52] U.S. Cl. ..... 439/188; 439/107; 439/650; 200/51.09

[58] Field of Search ..... 200/51.09, 51.17, 51 R; 439/52, 188, 217, 218, 650, 653, 92, 106, 107

[56] References Cited

U.S. PATENT DOCUMENTS

| | | | |
|---|---|---|---|
| 5,035,635 | 7/1991 | Tsai et al. | 439/188 |
| 5,071,360 | 12/1991 | Lindow et al. | 439/188 X |
| 5,098,307 | 3/1992 | Francisco | 439/188 X |
| 5,112,237 | 5/1992 | Yang | 439/188 |
| 5,259,778 | 11/1993 | Zhang | 439/188 |

*Primary Examiner*—Khiem Nguyen
*Attorney, Agent, or Firm*—Hedman, Gibson & Costigan

[57] ABSTRACT

A socket terminal has a shell, two electrodes, a ground and at least one socket member. The shell has a base and a cover which is mounted on the base. The base has a first side which defines two grooves for receiving the electrodes and a second side which defines a channel for receiving the ground. The base further defines at least one aperture. The socket member has a casing which has a disk-shaped shaft formed thereon whereby the disk-shaped shaft is received in the opening defined in the cover so that the casing is pivotable between a first position and a second position. Two conductive strips each has a first end received in the casing and a second end disposed below the casing. A grounded strip has a first end received in the casing and a second end disposed secured to the casing by means of a screw with a relatively large head. The head of the screw is inserted through the aperture defined in the base and is further engaged with the ground. The second ends of the conductive strips contact the electrodes when the casing is in the first position. The second ends of the conductive strips do not contact the electrodes when the casing is in the second position. The second end of the grounded strip is always engaged with the ground.

13 Claims, 4 Drawing Sheets

SOCKET TERMINAL

BACKGROUND OF THE INVENTION

The present invention relates to a socket terminal with a three-slot socket member for receiving a three-lead plug, wherein the three-slot socket member is pivotable between "ON" position and "OFF" position.

The present applicant's U.S. Pat. No. 5,350,310 teaches a socket terminal with a two-hole socket member for receiving a two-lead plug, wherein the two-hole socket member is pivotable between "ON" position and "OFF" position. However, the socket terminal which is taught in U.S. Pat. No. 5,350,310 is not useful for any three-lead plug. Therefore, there is a need for a socket terminal which is useful for three-lead plugs.

SUMMARY OF THE INVENTION

It is an object of the present invention to provide a socket terminal which has a shell, two elect:codes, a ground and at least one socket member. The shell has a base and a cover which is mounted on the base. The base has a first side which defines two grooves for receiving the electrodes and a second side which defines a channel for receiving the ground. The base further defines at least one aperture. The socket member has a casing which has a disk-shaped shaft 1 formed thereon whereby the disk-shaped shaft is received in the opening defined in the cover so that the casing is pivotable between a first position and a second position. Two conductive strips each has a first end received in the casing and a second end disposed below the casing. A grounded strip has a first end received in the casing and a second end disposed secured to the casing by means of a screw with a relatively large head. The head of the screw is inserted through the aperture defined in the base and is further engaged with the ground. The second ends of the conductive strips contact the electrodes when the casing is in the first position. The second ends of the conductive strips do not contact the electrodes when the casing is in the second position. The second end of the grounded strip is always engaged with the ground.

For a better understanding of the present invention and objects thereof, a study of the detailed description of the embodiments described hereinafter should be made in relation to the accompanying drawings.

DETAILED DESCRIPTION OF THE PREFERRED EMBODIMENT

U.S. Pat. No. 5,350,310 is incorporated in the present invention.

Figure 1:
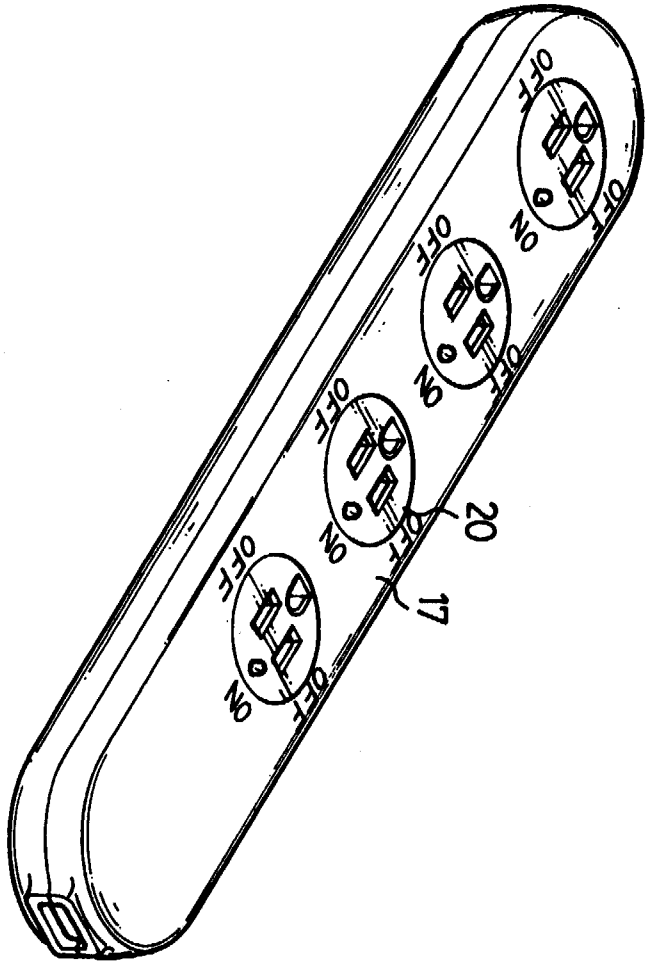
FIG. 1 is an isometric view of a socket terminal in accordance with the preferred embodiment of the present invention.

Referring to FIG. 1, in accordance with the preferred embodiment of the present invention, a socket terminal has a shell which has a base 10 and a cover 17 which is mounted on the base 10.

Figure 2:
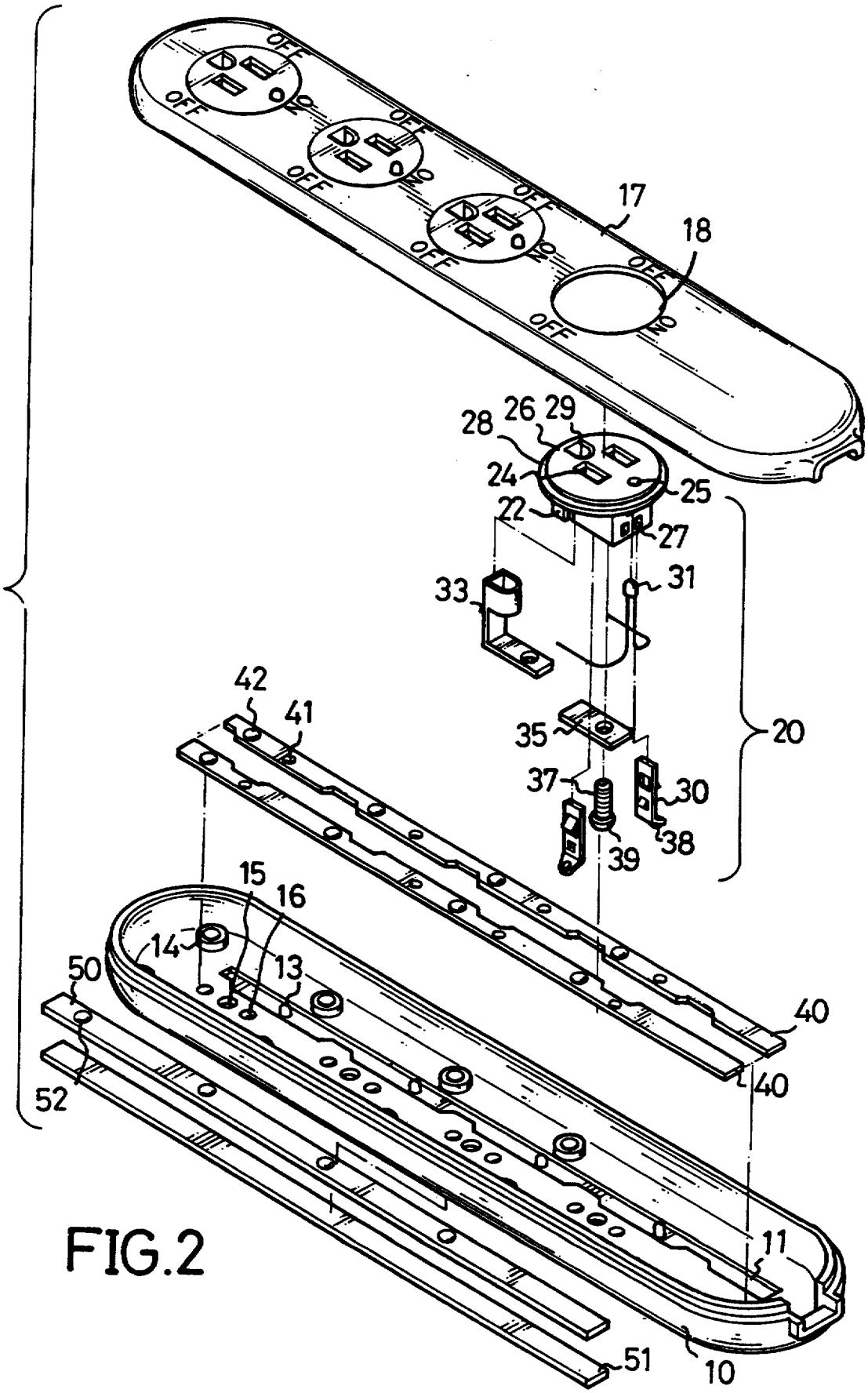
FIG. 2 is an exploded view of the socket terminal shown in FIG. 1.

Referring to FIG. 2, a plurality of apertures 14 are defined in the base 10. A corresponding number of screws (not shown) can be inserted through the apertures 14 and secured into the cover 17 so as to combine the base 10 and the cover 17.

Figure 3:
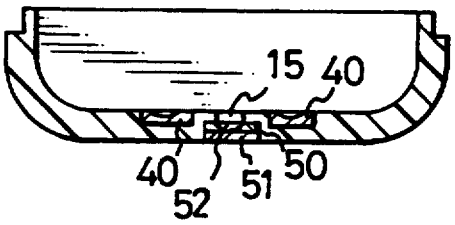
FIG. 3 is a cross-sectional view of a base of the socket terminal shown in FIG. 2.

Two channels 11 are defined in an upperside of the base 10. A channel 12 (see FIG. 3) is defined in an underside of the base 10, so that the channel 12 is disposed between the channels 11. A plurality Of protrusions 13 project from the upperside of the base 10, within each channel 12. A plurality of apertures 15 and a corresponding number of pairs of recesses 16 are defined in the upperside of the base 10 between the channels 11 so that each aperture 15 is disposed between a corresponding pair of recesses 16.

Two electrodes 40 which each define a corresponding number of apertures 41 are received in the channels 11 so that the protrusions 13 are inserted through the apertures 41. The protrusions 13 are then heat pressed so as to have larger diameters in order to lock the electrodes 40 on the base 10. Each electrode 40 further defines a plurality of female contacts 42.

A ground 50 which defines a plurality of female contacts 52 is received in the channel 12 so that each recess 52 is aligned with a corresponding aperture 15. An electrically isolating strip 51 is further received in the recess 12. The electrically isolating strip, 51 is attached to the base 10 by means of ultrasonic wave. Thus, the ground 50 is attached to the base 10.

A plurality of openings 18 are defined in the cover 17.

Figure 4:
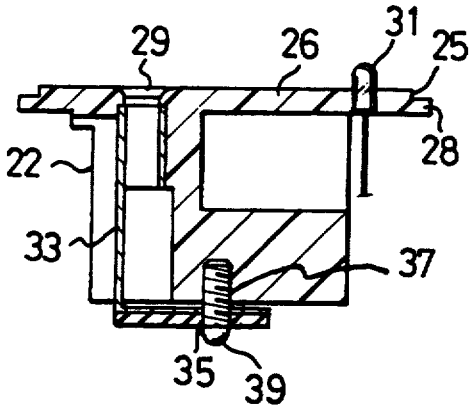
FIGS. 4 and 5 are two different cross-sectional views of a three-slot socket member of the socket terminal shown in FIG. 2.
Figure 5:
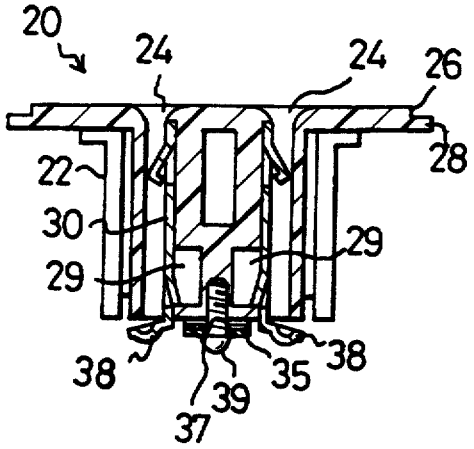

Referring to FIGS. 4 and 5, a plurality of three-slot socket members 20 each include a casing 22, a light emitting diode 31, two conductive strips 30 and a grounded strip 33. Similar to each casing 22 of U.S. Pat. No. 5,350,310, each casing 22 of the present, invention has two slots 24, a disk-shaped shaft 26, an opening 27, an annular flange 28 and two recesses 29. However, each casing 22 of the present invention further defines an aperture 25 through the disk-shaped shaft 26 and the annular flange 28 and a slot 29.

The conductive strips 30 of the present invention are similar in structure to and identical in function to the conductive strips 30 of U.S. Pat. No. 5,350,310, therefore, the conductive strips 30 will not be further described in detail. However, it must be described that each conductive strip has a male contact 38, for the convenience of further description of the present invention.

The way in which the conductive strips 30 are received in the slots 24 is identical to the way in which the conductive strips 30 are received in the slots 24 of U.S. Pat. No. 5,350,310. Therefore, further details of the conductive strips 30 will not be given.

A light emitting diode (LED) 31 is received in the aperture 25. The LED 31 has two leads.

The grounded strip 33 is an angled element which has a tubular end and a flat end defining an aperture (not numbered). An electrically isolating tab 35 defines an aperture (not numbered). The tubular end of the conductive strip 32 is received in the slot 29, and the flat end of the grounded strip 33 is disposed below the casing 22. A screw 37 which has a relatively large head 39 is inserted through the apertures which are defined the electrically isolating tab 35 and the grounded strip 33. The screw 37 is secured to the casing 22. Thus, the grounded strip 33 is attached to the casing 22. The head 39 is aligned with the male contacts 38 of the conductive strips 30.

The three-slot socket members 20 are received in the shell which consists of the base 10 and the cover 17 so that each disk-shaped shaft 26 is received in a corresponding opening 18 and that each head 29 is received in a corresponding aperture 15 and a corresponding recess 52. Thus, each three-slot socket member 20 is pivotable between "ON" and "OFF" positions.

Figure 6:
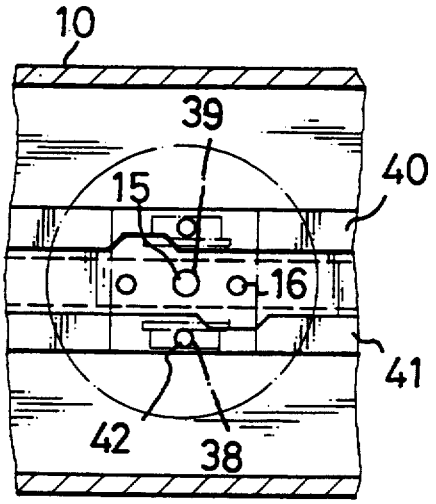
FIG. 6 is a top partial view of two electrodes and a ground of the socket terminal shown in FIG. 2, further showing in phantom lines the three-slot socket member disposed in "ON" position on the electrodes and the ground.

Referring to FIG. 6, a segment of the base 10 is shown in bold lines, and a three-slot socket member 20 is shown in phantom lines. A male contact 38 of the three-socket member 20 is received in a female contact 42 of an electrode 40, the remaining contact 38 of the three-slot socket member 20 is received in a female contact of the remaining electrode 40, so that the three-slot socket member 20 is in "ON" position. At this instant, the leads of the LED contacts the electrodes 40 so as to light the LED 31 in order to indicate that the three-slot socket member 20 is in "ON" position.

Figure 7:
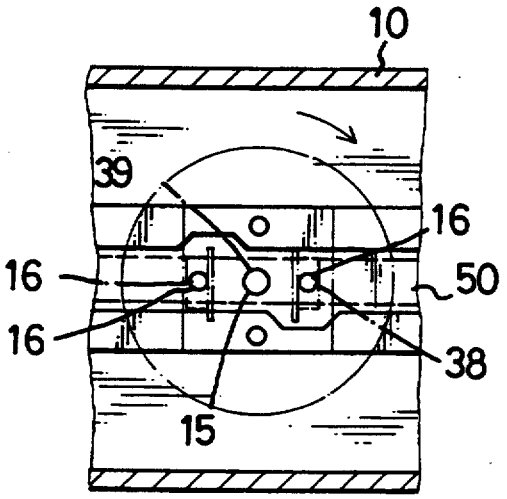
FIG. 7 is a top partial view similar to FIG. 6, but showing the three-slot socket member disposed in "OFF" position.

The three-slot socket member 20 is pivotable from "ON" position shown in FIG. 6 to "OFF" position shown in FIG. 7. The pair of male contacts 38 of=the three-socket member 20 is received in a pair of recesses 16 so that the three-slot socket member 20 is in "OFF" position.

As shown in FIGS. 6 and 7, the head 39 must be coaxial with the disk-shaped shaft 26, so that the three-slot socket member 20 is pivotable in the shell. That is, the grounded strip 33 must be angled. At this instant, the leads of the LED 31 do not contact the electrodes 40 so as to turn off the LED in order to indicate that the three-hole socket member 20 is in "OFF" position.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

What is claimed is:

1. A socket terminal comprising:

a shell comprising a base and a cover which is mounted on the base, wherein the cover defines at least an opening;

two electrodes which are mounted on the base and connected to a power supply;

a ground which are attached to the base; and at least one socket meter comprising:

a casing comprising a disk-shaped shaft formed thereon whereby the disk-shaped shaft formed on the casing is received in the opening defined in the cover so that the casing is pivotable in the shell between a first position and a second position;

two conductive strips each comprising a first end received in the casing and a second end disposed below the casing; and a grounded strip comprising a first end received in the casing and a second end disposed below the casing;

whereby the second ends! of the conductive strips contact the electrodes when the casing is in the first position, and the second ends of the conductive strips do not contact the electrodes when the casing is in the second position, and the second end of the grounded strip always contacts the ground.

2. A socket terminal in accordance with claim 1 wherein the second end of the grounded strip is secured to the casing by means of a screw with a relatively large head for functioning as a male contact.

3. A socket terminal in accordance with claim 2 wherein the ground defines a female contact for receiving the head of the screw.

4. A socket terminal in accordance with claim 2 wherein the base comprises a first side on which the electrodes are mounted, a second side on which the ground is mounted, and the base defines at least one aperture, so that the head of the screw is inserted through the aperture defined in the base and is engaged with the ground.

5. A socket terminal in accordance with claim 4 wherein the ground defines a female contact for receiving the head of the screw.

6. A socket terminal in accordance with claim 1 wherein the second end of each of the conductive strips comprises a male contact formed thereon.

7. A socket terminal in accordance with claim 6 wherein each of the electrodes defines a female contact for receiving the male contact of a corresponding one of the conductive strips.

8. A socket terminal in accordance with claim 1 wherein each of the electrodes and the ground defines a plurality of apertures, and the base comprises a corresponding number of protrusions projecting therefrom, whereby the protrusions projecting from the base are inserted through the apertures defined in the electrodes and the ground so as to retain the electrodes and the ground in position.

9. A socket terminal in accordance with claim 8 wherein each of the protrusions comprises a relatively large head in order to lock the electrodes and the ground to the base.

10. A socket terminal in accordance with claim 1 comprising an electrically isolating tab in order to cover the second end of the grounded strip.

11. A socket terminal in accordance with claim 1 comprising an electrically isolating strip in order to cover the ground.

12. A socket terminal in accordance with claim 1 comprising a light-emitting diode (LED) comprising two leads, when the casing is in the first position, the leads of the LED contact the electrodes so as to light the LED in order to indicate that the socket member is turned on.

13. A socket terminal in accordance with claim 4 wherein the first side of the base defines two channels for receiving the electrodes, and the second side of the base defines a channel for receiving the ground.

* * * * *